US010011389B2

(12) United States Patent
Pang

(10) Patent No.: US 10,011,389 B2
(45) Date of Patent: Jul. 3, 2018

(54) PLATFORMS MADE OF PAPER MATERIALS

(71) Applicant: AXPORT SOLUTION SDN. BHD., Rawang, Selangor Darul Ehsan (MY)

(72) Inventor: Shaw Leong Pang, Selangor (MY)

(73) Assignee: AXOPORT SOLUTION SDN. BHD. (MY)

( * ) Notice: Subject to any disclaimer, the term of this patent is extended or adjusted under 35 U.S.C. 154(b) by 0 days.

(21) Appl. No.: 15/508,690

(22) PCT Filed: Sep. 11, 2015

(86) PCT No.: PCT/MY2015/000077

§ 371 (c)(1),
(2) Date: Mar. 3, 2017

(87) PCT Pub. No.: WO2016/039615

PCT Pub. Date: Mar. 17, 2016

(65) Prior Publication Data

US 2017/0275050 A1 Sep. 28, 2017

(30) Foreign Application Priority Data

Sep. 12, 2014 (MY) ..... 2014702608

(51) Int. Cl.
*B65D 19/00* (2006.01)

(52) U.S. Cl.
CPC ..... *B65D 19/0095* (2013.01); *B65D 2519/00019* (2013.01); *B65D 2519/00054* (2013.01);
(Continued)

(58) Field of Classification Search
CPC ..... B65D 19/20; B65D 2519/00019; B65D 2519/00054; B65D 2519/00089;
(Continued)

(56) References Cited

U.S. PATENT DOCUMENTS 2,432,295 A * 12/1947 Donahue ..... B65D 19/0012 108/51.3
2,444,183 A 6/1948 Cahners
(Continued)

FOREIGN PATENT DOCUMENTS

WO 2007083988 A2 7/2007
WO 2011108915 A1 9/2011
(Continued)

*Primary Examiner* — Jose V Chen
(74) *Attorney, Agent, or Firm* — Renner Kenner Greive Bobak Taylor & Weber

(57) ABSTRACT

A novel platform made of paper materials for the storage, stacking, handling and transportation of goods comprises a top deck comprising a plurality of top deck boards (20*a*-20*e*) and a plurality of support beam assemblies (30). The plurality of top deck boards (20*a*-20*e*) are attached at regular intervals and perpendicular to the plurality of support beam assemblies (30). In the platform, the top deck boards (20*a*-20*e*) and the support beam assemblies (30) are both constructed solely from a combination of a plurality of longitudinal elements having a L-shaped cross-section. The novel platform may further include a bottom deck (40*a*-40*c*) comprising a plurality of bottom deck boards which are also constructed solely from a combination of a plurality of longitudinal elements having a L-shaped cross-section.

20 Claims, 13 Drawing Sheets

(52) U.S. Cl.
CPC ..... *B65D 2519/00089* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00373* (2013.01); *B65D 2519/00572* (2013.01)

(58) Field of Classification Search
CPC ..... B65D 2519/00303; B65D 2519/00358; B65D 2519/00388; B65D 2519/00562
USPC ..... 108/51.11, 53.1, 56.1
See application file for complete search history.

(56) References Cited

U.S. PATENT DOCUMENTS 2,913,206 A * 11/1959 Paris ..... B65D 19/36 108/51.3
3,131,656 A * 5/1964 Houle ..... B65D 19/0095 108/51.3
3,464,371 A * 9/1969 Gifford ..... B65D 19/0012 108/51.3
3,602,158 A * 8/1971 Skaggs ..... B65D 19/0026 108/5
3,659,534 A * 5/1972 Childs ..... B65D 19/0012 108/51.3
5,050,506 A 9/1991 Fiedler
5,076,176 A * 12/1991 Clasen ..... B65D 19/0012 108/51.3
5,355,812 A * 10/1994 Kilpatrick ..... B65D 19/0012 108/51.3
5,383,409 A * 1/1995 Hayakawa ..... B65D 19/0016 108/51.3
5,537,935 A * 7/1996 Otaguchi ..... B65D 19/0012 108/51.3
5,595,125 A * 1/1997 Bridges, Jr. ..... B65D 19/0012 108/51.3
5,660,118 A * 8/1997 Adams, Jr. ..... B65D 19/38 108/51.3
5,881,652 A * 3/1999 Besaw ..... B65D 19/0012 108/51.3
5,996,509 A * 12/1999 Lai ..... B65D 19/0012 108/51.3
6,394,003 B1 * 5/2002 Lacy, III ..... B65D 19/02 108/51.3
7,086,338 B2 * 8/2006 Horiuchi ..... B65D 19/0012 108/51.3
8,397,916 B1 * 3/2013 Cassidy ..... B65D 19/0026 108/51.3
RE44,178 E * 4/2013 Trickett ..... B65D 19/0081 108/51.11
2004/0187745 A1 9/2004 Rojas
2006/0278137 A1 * 12/2006 Shimada ..... B65D 19/0095 108/51.11
2010/0175595 A1 * 7/2010 Grietens ..... B65D 19/0095 108/51.3
2010/0224103 A1 9/2010 Ho
2011/0132238 A1 * 6/2011 Jaegers ..... B65D 19/0026 108/55.1
2015/0321792 A1 * 11/2015 Joung ..... B65D 19/38 108/57.25
2016/0130032 A1 * 5/2016 Pratt ..... B65D 19/20 108/51.3

FOREIGN PATENT DOCUMENTS

WO 2013073928 A1 5/2013
WO 2014129883 A1 8/2014

* cited by examiner

PLATFORMS MADE OF PAPER MATERIALS

FIELD OF THE INVENTION

The present invention relates to the field of logistics, warehousing and storage of goods, and specifically concerns platforms, particularly skids and pallets which are constructed from elements which are made of paper materials.

BACKGROUND

Skids and pallets are rigid platforms which are used for the assembly, storage, stacking, handling and transportation of goods as a unit load, and traditionally have been and are still made of wood.

The construction of a pallet and a skid are generally similar. A pallet comprises a top deck, a bottom deck and a plurality of stringers to support both the top and bottom deck boards. In contrast, a skid comprises of only a plurality of top deck boards, and a plurality of runners which support the top deck. In short, the primary difference between the two is that a skid does not have a bottom deck. A skid may also be considered as a pallet without a bottom deck.

Due to the similar function and appearance of skids and pallets, it is common for laymen and even the logistic industry to inaccurately refer to a skid as a pallet and vice versa.

Skids and pallets are traditionally manufactured from raw wood which originate from living or dead trees. However, the raw wood used is often infested by pests such insects and beetles, and may not have been sufficiently processed or treated to remove or exterminate the pests. The possibility of such pests being spread by infested wooden skids and pallets, and the threat posed by invasive pests to the ecology and agriculture of a country is a cause for serious concern.

In accordance with the ISPM-15 Standard which regulates the use of wood packaging material in international trade, raw wood used for skid and pallet production have to be heat treated or chemically fumigated to exterminate and prevent the spread of pests through the shipment of goods by importation or exportation.

Wooden skids and pallets are also often discarded after use, or when damaged. The relatively short life span of wooden skids and pallets coupled with the competing demand for raw wood by other industries (such as the furniture industry) makes wooden skids and pallets not only wasteful but also expensive.

In view of these drawbacks, wooden skids and pallets have accordingly been supplemented by skids and pallets which are made of plastic and paper materials, which are exempted from the ISPM-15 Standard.

However, plastic and paper skids and pallets are not without drawbacks, and each has their associated problems.

Plastic skids and pallets are generally durable, and are not subject to the ISPM-15 Standard. While this is an important and obvious advantage, the unit cost of a plastic skids or pallet is prohibitively high due to the cost involved in tooling and mould making.

The industry has also seen the introduction of skids and pallets which are made of paper materials. Paper materials in this context, relates to thick laminated paper sheet, card stock and also corrugated paper. Skids and pallets made of paper materials have proven to be a viable and more cost-effective alternative. The wide acceptance of skids and pallets made of paper materials has generated a whole industry dedicated to the design and production of such skids and pallets.

There has accordingly been a veritable selection of paper skids and pallets, some of which are constructed from intricate and complex designs stamped on singular laminated paper or card stock with numerous fold lines, tabs and slots which must be bent and folded in many sections to form a finished skids or pallet, and some which are constructed from separate components which are made of laminated paper or card stock of different shapes and thicknesses, which have been subjected to rolling or folding to form structural components, which are then combined to form a complete skids or pallet.

The document U.S. Pat. No. 8,291,836 B2 (Jian, et al.) discloses a paper pallet which has a load bearing structure comprising of a plurality of first and second support members designed to engage and interlock with one another. Each support member is formed from paper or card stock cut to a specific and intricate shape and incorporating a plurality of interlocking slots, which is then bent and folded together. The first support member interlocks with a second support member via an interlocking slot.

Although such a paper pallet is a viable solution to the problem of wooden pallets, it along with other similarly complex paper pallets involve significant geometric design with a high degree of precision, the fabrication of tooling for producing two different support members with its associated fold lines and slots, and also substantial labour to bend, fold and assemble the cut paper stock. All of these add to the cost of production.

The document WO 2009/034495 A1 (Chong) discloses a paper pallet constructed from a combination of T-shaped elongate elements, channel members (i.e., an elongate U-shaped or C-shaped element) and hollow core inserts. As can be seen in the document, such a pallet combines two L-shaped elongate elements to form a T-shaped elongate element, which is inserts into a slot cut into a channel member, and each channel member includes a plurality of hollow core inserts.

The L-shaped elongate elements are generally constructed from paper angle board material which is made of laminated paper, which are produced by an angle board making machine.

The use of paper channel members in the construction of a paper pallet does in fact help create a robust load-bearing structure. However, the production of a channel member requires additional specialized machinery in the form of a paper channel making machine. The requirement for additional machinery in turn results in additional cost and capital expenditure, or possibly requires the inclusion of an additional vendor in the supply chain at the very least.

Furthermore, the cutting of slots on each channel member is also a task which requires precision and also additional tooling and an additional process in its manufacture.

It can be seen that a paper pallet which makes use of paper materials of multiple shapes, although practicable, is far from ideal from an economic point of view.

Finally, the document WO 2011/108915 A1 by the applicant discloses a paper pallet that comprises a plurality of elongate members forming a top portion of the pallet and a plurality of beams secured to the plurality of elongate members in a criss-cross manner to form a bottom portion of the pallet, with the plurality of elongate members and beams being constructed from a plurality of supporting elements and a plurality of L-section elements. The supporting elements typically being comprised of lengths of cylindrical shaped sections or half-cylindrical sections, which are made from paper core due to its strength and rigidity.

The paper pallet according to WO 2011/108915 A1 is also a viable alternative to wooden pallets. However, its reliance on paper core has a number of disadvantages. Paper core as its name suggests, is made of laminated paper which has been formed into a hollow cylindrical core, and is used in the supply of industrial paper. New paper core material is readily obtainable from paper manufacturers. However, new paper core material is considered relatively expensive, which adds significantly to the cost of manufacturing the paper pallet.

It is more economical to re-use paper core which has been discarded by the printing industry as a by-product. However, the printing industry is not necessarily a consistent or reliable source of paper core, and its availability is obviously dependent on the industry's rate of usage of paper. Discarded paper core may occasionally be short in supply or difficult to obtain during lean periods in the printing industry.

A further disadvantage of the paper pallet according to WO 2011/108915 A1 is in its disposal. The plurality of elongate members used in the top portion of the pallet and the plurality of beams are made of L-section longitudinal elements, and when the pallet is dismantled for disposal, the L-section elements may be fed through an industrial shredder. However, the supporting elements made of paper core are often too thick and rigid to be shredded by the same equipment.

In view of all the disadvantages described above, it is desirable to have a skid or pallet made of paper materials that is simpler in design and construction, and that is more economical to manufacture.

The present invention was developed in consideration of the above requirements.

SUMMARY OF THE INVENTION

In a first embodiment of the present invention, a platform made of paper materials for the storage, stacking, handling and transportation of goods comprises a top deck with a plurality of top deck boards and a plurality of support beam assemblies as its basic components is disclosed.

The platform made of paper materials according to the first embodiment is assembled by attaching the plurality of top deck boards at regular intervals perpendicular to the top of the plurality of support beam assemblies.

Both the top deck boards and the support beam assemblies are made by solely combining a plurality of longitudinal elements having a L-section to form structural members of different configurations.

In a second embodiment of the present invention, a platform made of paper materials for the storage, stacking, handling and transportation of goods comprises a top deck with a plurality of top deck boards, a bottom deck with a plurality of bottom deck boards and a plurality of support beam assemblies as its basic components is disclosed.

The platform made of paper materials according to the second embodiment is made by attaching the plurality of support beam assemblies at regular intervals between and perpendicular to the plurality of top deck boards and bottom deck boards.

The top deck boards, the bottom deck boards and the support beam assemblies are all made by solely combining a plurality of longitudinal elements having a L-section to form structural members of different configurations.

In the first and second embodiments of the platform made of paper materials according to the invention, the plurality of top deck boards may comprise either of the following configurations:

1. four longitudinal elements having a L-section which have been combined to form a longitudinal structural element with a square or rectangular-shaped cross-section,
2. four longitudinal elements having a L-section which have been combined to form a longitudinal structural element with an inverted U-shaped cross-section, which has a flange on both sides of the open end of the structural element.

In the first configuration of the plurality of top deck boards, each of the longitudinal elements preferably has a L-section which has a first leg that has a length that is greater than the length of the second leg, to produce a top deck board with a rectangular-shaped cross section.

In the second configuration of the plurality of top deck boards, the four longitudinal elements with a L-section may comprise:

1. a combination of two L-sections with a first leg which has a length that is greater than the length of the second leg and two L-sections with a first leg which has a length that is the same as the length of the second leg, or
2. a combination of L-sections, all having a first leg which has a length that is the same as the length of the second leg.

In the first and second embodiments of the invention, the plurality of support beam assemblies may comprise either of the following configurations:

1. a top horizontal support member and a plurality of vertical support members, or
2. a top horizontal support member, a plurality of vertical support members and a base horizontal support member.

In the second embodiment of the invention, if the plurality of support beam assemblies comprises the first configuration, the plurality of bottom deck boards would then be attached to the plurality of vertical support members.

In the first configuration of the support beam assembly, the top horizontal support member and the plurality of vertical support members are both made by solely combining longitudinal elements having a L-section, in which the top end of each vertical support member corresponds to and is received by the top horizontal support member.

In the second configuration of the support beam assembly, the top horizontal support member, the plurality of vertical support members and the base horizontal support member are all made by solely combining longitudinal elements having a L-section, in which top end of each vertical support member corresponds to and is received by the top horizontal support member, and the bottom end of each vertical support member corresponds to and is received by the base horizontal support member.

The first and second configurations of the support beam assemblies described above preferably have a top horizontal structural member which comprises two longitudinal elements having a L-section which are arranged to form a longitudinal structural member with an inverted U-shaped cross-section, in which the width of the opening of the longitudinal structural member corresponds to the width of the upper end of the vertical support member.

Both configurations of the support beam assemblies described above may also be modified so that the top horizontal structural member additionally comprises a plurality of support members which correspond to the width of the opening of the top horizontal structural member, and which are received by the opening of the horizontal structural member, in which each support member is made by solely combining a plurality of truncated L-section elements.

The support members described above are formed by a pair of truncated L-section elements attached together so as to create a support member with two planar contact surfaces with either a Z-shaped cross-section, or a U-shaped cross-section.

In the two configurations of the support beam assemblies described above, the plurality of vertical support members are formed by a pair of L-section elements attached together so as to create a vertical support member with two planar contact surfaces with a Z-shaped cross-section, or a U-shaped cross-section.

The plurality of vertical support members may alternatively be formed by four L-section elements attached together so as create a vertical support member with four planar contact surfaces with a rectangular or square-shaped cross-section, or a S-shaped cross-section.

The two configurations of the support beam assemblies and their modifications described above preferably have a base horizontal structural member that comprises two longitudinal elements having a L-section which are arranged to form a longitudinal structural member having a U-shaped cross-section, in which the width of the opening of the longitudinal structural member corresponds to the width of the bottom end of the vertical support member.

The platform made of paper materials for the storage, stacking, handling and transportation of goods according to the first and second embodiments of the invention and its variants and modifications described above, may further comprise a stiffening member attached perpendicularly to each end of the plurality of top deck boards, in which the stringer member is a longitudinal element with a L-section.

In the platform made of paper materials for the storage, stacking, handling and transportation of goods according to the second embodiment of the invention, the plurality of bottom deck boards may comprise of four longitudinal elements having a L-section which have been combined to form a longitudinal structural element with a square or rectangular-shaped cross-section.

Each of the longitudinal elements forming the plurality of bottom deck boards preferably has a L-section which has a first leg that has a length that is greater than the length of the second leg, to produce a bottom deck board with a rectangular-shaped cross section.

In a third embodiment of the invention, which is a modification of the second embodiment of the invention, each of the plurality of bottom deck boards simply comprises a planar longitudinal element which is made of paper materials.

In a variant of the fourth embodiment of the present invention, a platform for the storage, stacking, handling and transportation of goods comprises a top deck comprising a processed wood-based panel or board, and a plurality of support beam assemblies. The panel or board is attached on top and perpendicular to the plurality of support beam assemblies, and the support beam assemblies are made solely from a combination of a plurality of longitudinal elements having a L-section which are made of paper materials.

In another variant of the fourth embodiment, instead of a processed wood-based panel or board, the top deck comprises a plurality of top deck boards comprising planks made of processed wood-based material.

In a fifth embodiment of the present invention, a platform for the storage, stacking, handling and transportation of goods comprises a top deck comprising a processed wood-based panel or board, a bottom deck comprising a plurality of bottom deck boards and a plurality of support beam assemblies. The plurality of support beam assemblies are attached at regular intervals between and perpendicular to the top deck and the plurality of bottom deck boards. The plurality of bottom deck boards and the plurality of support beam assemblies are made solely from a combination of a plurality of longitudinal elements having a L-section which are made of paper materials.

In a variant of the fifth embodiment, instead of a processed wood-based panel or board, the top deck comprises a plurality of top deck boards comprising planks made of processed wood-based material.

In a sixth embodiment of the present invention which is a modification of the fifth embodiment, instead of a plurality bottom deck boards, the bottom deck comprises a plurality of planar longitudinal elements which are made of paper materials.

In a seventh embodiment of the present invention, a platform for the storage, stacking, handling and transportation of goods comprises a top deck comprising a processed wood-based panel or board, a bottom deck comprising a processed wood-based panel or board and a plurality of support beam assemblies.

The plurality of support beam assemblies are attached at regular intervals between and perpendicular to the top deck and the bottom deck. The plurality of support beam assemblies are made solely from a combination of a plurality of longitudinal elements having a L-section which are made of paper materials.

In a variant of the seventh embodiment, instead of a processed wood-based panel or board, the top deck comprises a plurality of top deck boards comprising planks made of processed wood-based material.

In another variant of the seventh embodiment, instead of a processed wood-based panel or board, the bottom deck comprises a plurality of bottom deck boards comprising planks made of processed wood-based material.

In still another variant of the seventh embodiment, instead of a processed wood-based panel or board, the bottom deck comprises a plurality of planar longitudinal elements which are made of paper materials.

In the platform made of paper materials for the storage, stacking, handling and transportation of goods according to the first to fifth embodiments of the invention and its variants and modifications described above, the L-section elements which are combined to form the individual structural components are attached to one another, and the individual structural components formed are attached to one another using metal staples, rivets or nails.

Alternatively, the L-section elements combined to form the individual structural components are attached to one another, and the individual structural components formed are attached to one another using an adhesive.

BRIEF DESCRIPTION OF THE DRAWINGS

The invention is illustrated, though not limited by the following description of embodiments that are being given by way of example only, with reference to the accompanying drawings in which.

DETAILED DESCRIPTION AND BEST MODE

A pallet as explained in the background of the invention comprises a top deck made up of a plurality of top deck boards, a bottom deck made up of a plurality of bottom deck boards and a plurality of support beams which are also known as stringers.

The plurality of top deck boards are attached perpendicular to the top of each of the plurality of stringers, and serves as a platform for stacking on goods. The plurality of bottom deck boards are attached perpendicular to the base of each of the plurality of stringers. The plurality of stringers supports the top deck boards and the bottom deck boards, and raises the top deck boards to create a raised platform which may be lifted and moved by a forklift, pallet jack, front-loader or other pallet lifting equipment.

A skid does not have a bottom deck, and comprises a top deck which is made up of a plurality of top deck boards and a plurality of support beams which are also called runners.

The plurality of top deck boards are attached perpendicular to the top of each of the plurality of runners, and serves as a platform for stacking on goods. The plurality of runners support the top deck boards, and raises the top deck boards to create a raised platform which may be lifted and moved by a forklift, pallet jack, front-loader or other pallet lifting equipment.

The inclusion of a bottom deck on a pallet, and the difference in terminology of the support beams used on pallets and skids notwithstanding, both pallets and skids possess obvious commonalities. The present invention is sufficiently versatile to be adapted for both pallets and skids, as will be demonstrated in the following detailed description.

The first embodiment of the invention relates to a skid that is made from paper materials. FIGS. 1 to 4 each illustrates a variant of the first embodiment of the invention in the perspective view, and demonstrates the commonality in the components used, and also the flexibility afforded by the different combinations and configurations of the various components that are disclosed by the invention.

Figure 1:
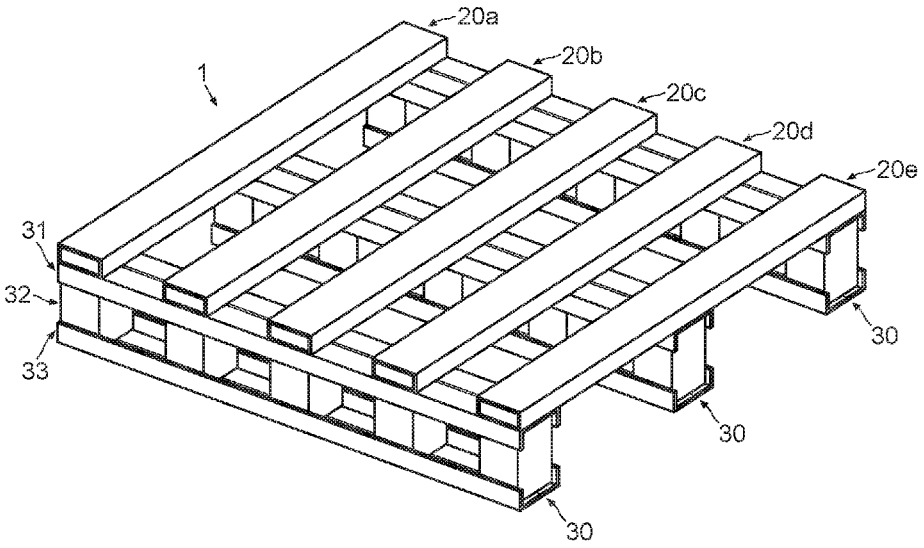
FIG. 1 illustrates a perspective view of a first variant of the first embodiment of the invention.

In FIG. 1, a first variant of a skid 1 made of paper is illustrated comprises a plurality of top deck boards (five in this case) which are spaced apart equally, and attached perpendicularly to the top of a plurality of support beam assemblies (three in this case) which supports the top deck boards.

Each of the top deck boards 20*a*-20*e* has a rectangular-shaped cross-section. The support beam assemblies 30 each include a top horizontal structural member 31, a plurality of vertical support members 32 (five in this case) whose positions correspond to the position of the top deck boards, and a base horizontal structural member 33.

The configuration of the first variant of the skid 1 according to the invention is suitable for a two-way entry skid, meaning that a forklift, or a pallet jack may only approach the skid from two specific sides in order to lift the skid.

Figure 2:
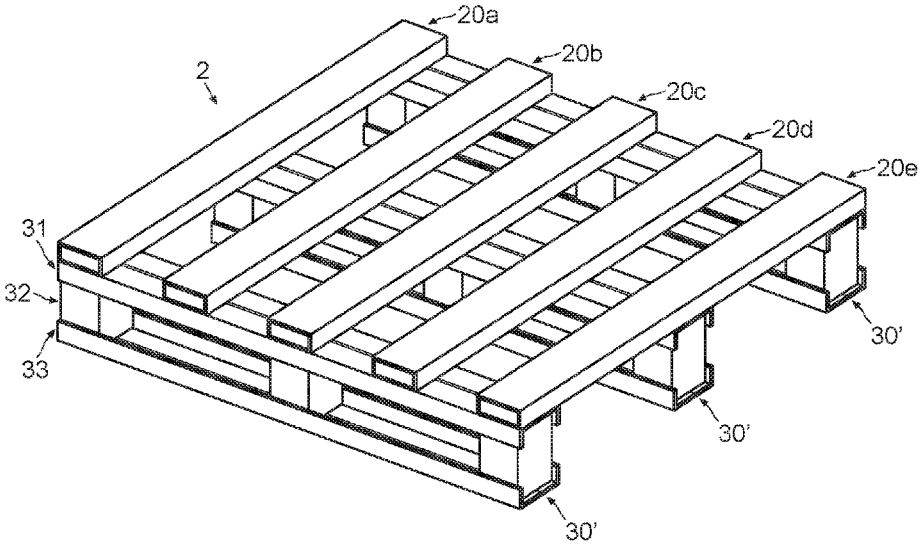
FIG. 2 illustrates a perspective view of a second variant of the first embodiment of the invention.

FIG. 2 illustrates a second variant of a skid 2 made of paper which also comprises a plurality of top deck boards (five in this case) which are spaced apart equally, and attached perpendicularly to the top of a plurality of support beam assemblies (three in this case) which supports the top deck boards.

As with the first variant, each top deck board 20*a*-20*e* has a rectangular-shaped cross-section. Each support beam assembly 30' still includes a top horizontal structural member 31 and a base horizontal structural member 33. However, there are only three vertical support members 32 in this variant, and the position of the three vertical support members correspond to the first, third and fifth top deck boards 20*a*, 20*c*, 20*e*.

Figure 15:
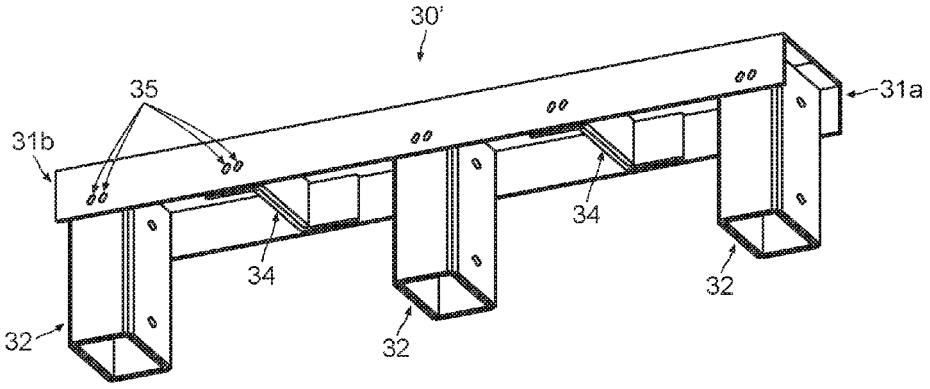
FIG. 15 illustrates a top horizontal structural member of a runner assembly, with a plurality of support members within.

Having fewer vertical support members 32, the top horizontal structural member 31 of each support beam assembly 30 also includes two support members 34 (as shown in FIG. 15), corresponding to the width of the opening of the top horizontal structural member 31 and located within the opening of the top horizontal structural member 31, and corresponding to the positions of the second and fourth top deck boards 20*b*, 20*d*. The purpose of the additional support members 34 is to reinforce the portions of the top horizontal structural member 31 where the second and fourth deck boards 20*b*, 20*d* are attached.

The configuration of the second variant of the skid 2 according to the invention is suitable for a four-way entry skid for use with a forklift which may approach the skid from any of the four sides in order to lift the skid. This configuration is also suitable only as a two-way entry skid for a pallet jack due to the ground clearance required by a pallet jack.

Figure 3:
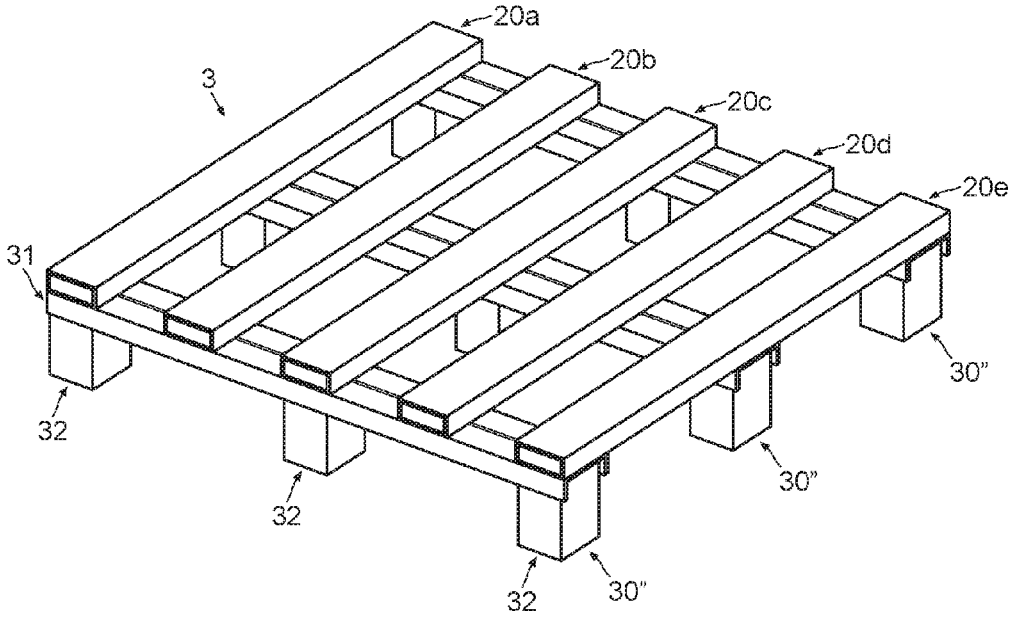
FIG. 3 illustrates a perspective view of a third variant of the first embodiment of the invention.

FIG. 3 illustrates a third variant of a skid 3 made of paper which also comprises a plurality of top deck boards (five in this case) which are spaced apart equally, and attached perpendicularly to the top of a plurality of support beam assemblies (three in this case) which supports the top deck boards.

As with the first and second variants, each top deck board 20*a*-20*e* has a rectangular-shaped cross-section. However, in the third variant, each support beam assembly 30" only includes a top horizontal structural member 31 and a plurality of vertical support members (three in this case). In FIG. 3, the position of the three vertical support members 32 correspond to the first, third and fifth top deck boards 20*a*, 20*c*, 20*e*.

Having fewer vertical support members 32, the top horizontal structural member 31 of each support beam also includes two support members 34 (as shown in FIG. 15) corresponding to the width of the opening of the top horizontal structural member 31 and located within the opening of the top horizontal structural member, and corresponding to the positions of the second and fourth top deck boards 20*b*, 20*d*. As in the second variant, the additional support members 34 serve to reinforce the portions of the top horizontal structural member where the second and fourth deck boards are attached to.

The configuration of the third variant of the skid 3 illustrated in FIG. 3 is suited as a four-way entry skid suitable for both forklifts and pallet jacks. The omission of the bottom horizontal structural member from the support beam assembly makes the skid more versatile, as pallet jacks have a minimum ground clearance requirement, and the presence of the bottom horizontal structural member may limit access or require the use of specific equipment.

The third variant is not limited to having just three vertical support members, and additional vertical support members may be attached in lieu of each support member, depending on the load the skid is required to bear. The addition of more vertical support members will, however, limit the skid to being a two-way entry skid.

Figure 4:
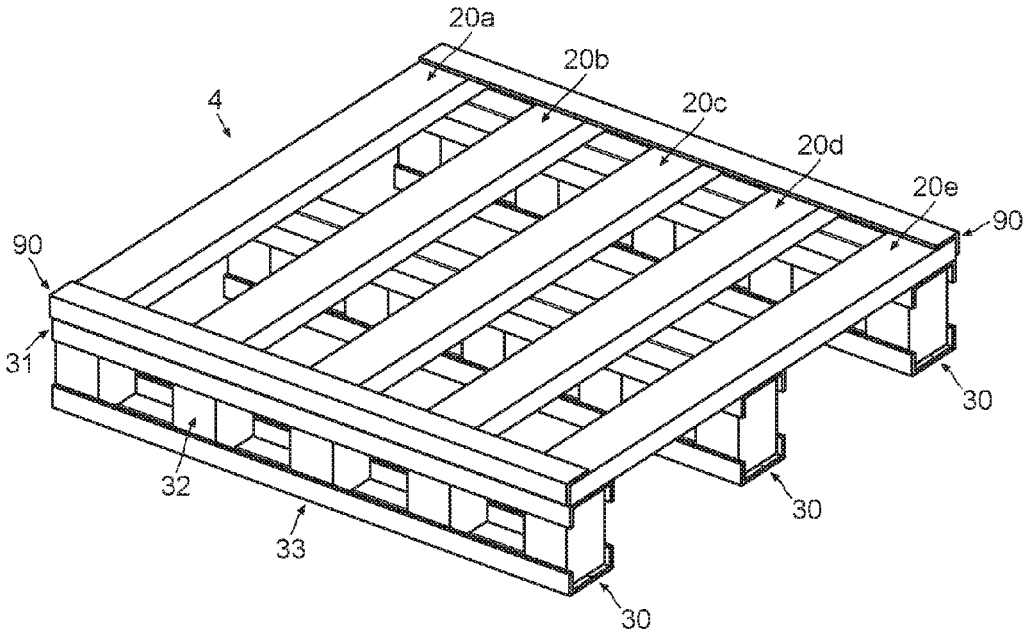
FIG. 4 illustrates a perspective view of a fourth variant of the first embodiment of the invention.

FIG. 4 illustrates a fourth variant of a skid 4 made of paper which is in fact a modification of the first variant to include a structural reinforcement in the form of a stiffening member 90 which is attached perpendicularly to each end of the plurality of top deck boards 20*a*-20*e*.

Although the fourth variant of the skid 4 made from paper has been illustrated in FIG. 4 as a modification of the first variant, this has been done solely by example and for illustrative purposes. The addition of a stiffening member 90 is not by any means limited to only the first variant of the skid, and a stiffening member may in fact be attached perpendicularly to each end of the plurality of top deck boards of the second or third variants of the skid according to the invention.

In the variants of the skid made of paper illustrated in FIGS. 1 to 4, and as described above, the top deck boards, the individual components which make up the runners are all made by solely combining L-shaped longitudinal elements of different dimensions. The stiffening member in the fourth variant is also a longitudinal element with a L-section.

Figure 9:
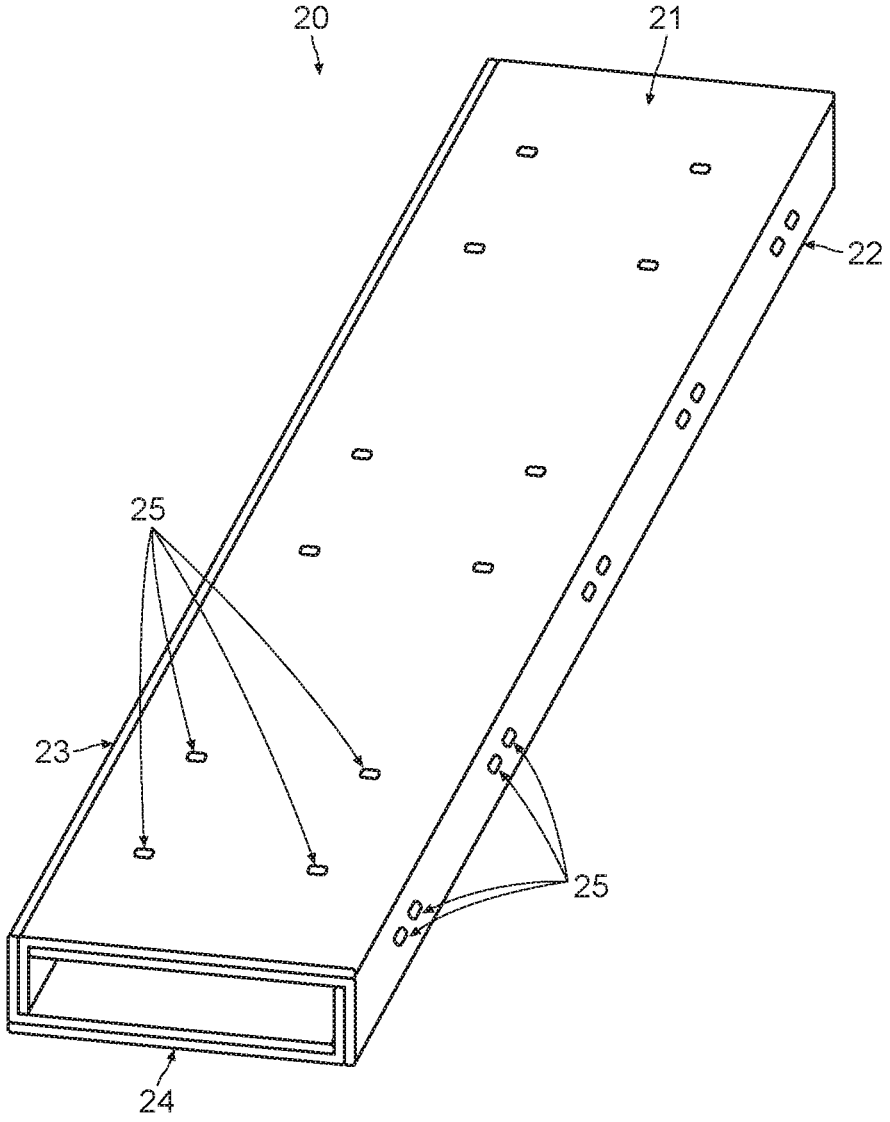
FIG. 9 illustrates a first configuration of a top deck board according to the invention.

As has been noted in the description of each variant of the paper skid illustrated in FIGS. 1 to 4, the plurality of top deck boards 20*a*-20*e* has a rectangular-shaped cross-section. FIG. 9 illustrates in greater detail, an individual top deck board with a rectangular-shaped cross-section.

In fact, deck boards of other shape configurations may be envisaged. For example, a top deck board with a flanged inverted U-shaped cross-section such as that illustrated in FIGS. 10 and 11 may substitute the top deck board with a rectangular-shaped cross-section.

The L-shaped longitudinal elements described thus far, which essentially constitutes the basic component used in the construction of the skids according to the invention, are created from angle boards, and are also known as corner boards.

Angle boards or corner boards are used to protect the corners and edges of boxes from damage during handling and transportation, and are generally made of laminated paper.

As explained previously in the background of the invention, angle boards are produced by an angle board making machine. A single machine is capable of producing angle boards of different dimensions and thicknesses, meaning that the skid according to the invention may be manufactured with less machinery than say the pallet disclosed in the document WO 2009/034495 A1.

To understand how a skid made of paper may be assembled from angle board material, let us consider the structure of an exemplary angle board.

Figure 5:
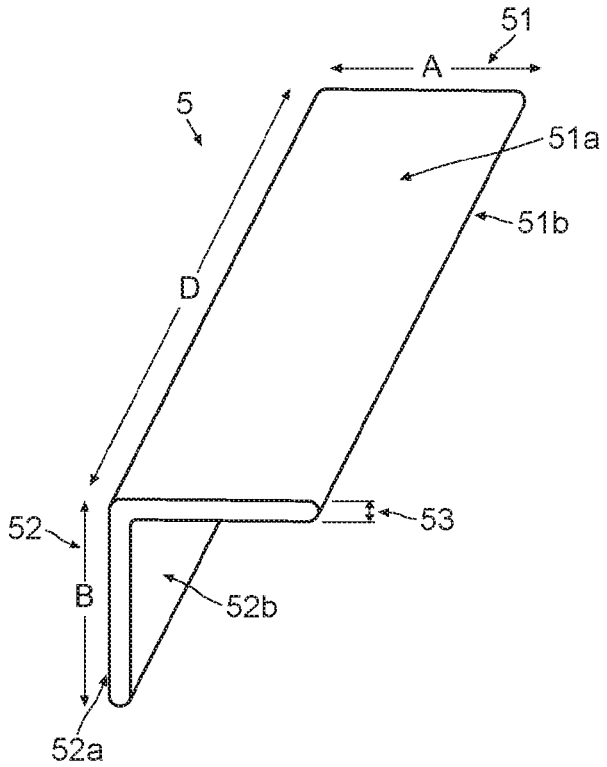
FIG. 5 illustrates an exemplary L-section element.

FIG. 5 illustrates a length of an exemplary angle board 5 which comprises a first leg 51, and an adjoining second leg 52 which are of a specific caliper 53. The first leg 51 and the adjoining second leg 52 are generally perpendicular or at right angles relative to one another. Each of the first leg 51 and the second leg 52 possesses an outer surface 51*a*, 52*a* and an inner surface 51*b*, 52*b*.

The length of the first leg 51 is known as 'leg length one' (A), and the length of the second leg 52 is known as 'leg length two' (B). The 'caliper' (C) 53 of the first and second legs is known as the thickness of the first and second legs, and the length of the angle board is the longitudinal length (D).

In order to construct a component, two or more sections of angle board may be combined and attached to each other by using industrial or heavy duty staples, or bonded to one another using a suitable adhesive. However, the use of staples is generally preferred, as the use of adhesives may require additional time for curing.

A combination of angle boards may also comprise lengths of angle boards of different caliper, and different leg lengths. The caliper of the angle boards used is dependent on the rigidity required in order for a skid to safely support a specific load.

By virtue of the first leg and the second leg of an angle board being generally perpendicular or at right angles to one another, it must be noted that all references herein to components having a C-, L-, S-, U- and Z-shaped cross-section must be viewed and understood in the context of elements having in cross-section, linear limbs with adjoining limbs which are all at right angles to one another.

Figure 6:
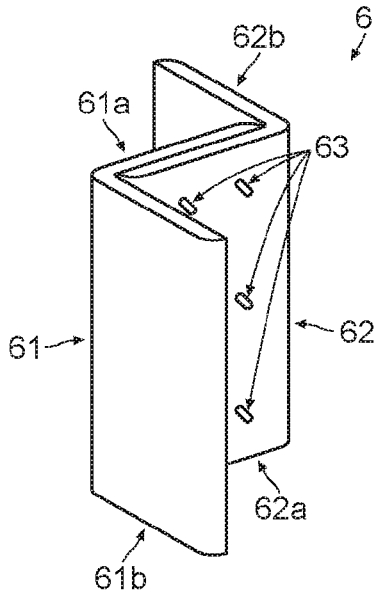
FIG. 6 illustrates a support member with a Z-shaped cross-section made by combining two L-section elements.

FIG. 6 illustrates how two sections of angle board are combined with one another to obtain a structural component with a Z-shaped cross-section 6, which may be used as a vertical support member of a support beam assembly, or a support member for reinforcing the top horizontal structural member of a support beam assembly.

To obtain a structural component with a Z-shaped cross-section, the inner surface of the first leg 61*a* of a section of angle board 61 is mated and attached to the inner surface of the first leg 62*a* of another section of angle board 62. In FIG. 6, the two sections of angle board 61, 62 are attached to one another by stapling the outer surface of the mated legs of the two angle board sections, and staples 63 are embedded at each attachment point.

Similarly, to obtain a structural component with a U-shaped cross-section, the inner surface of the first leg 61*a* of a section of angle board 61 is mated and attached to the outer surface of the second leg 62*b* of another section of angle board 62, and attaching the two sections of angle board 61, 62 to one another by stapling the outer surface of the mated legs of the two angle board sections.

Figure 7:
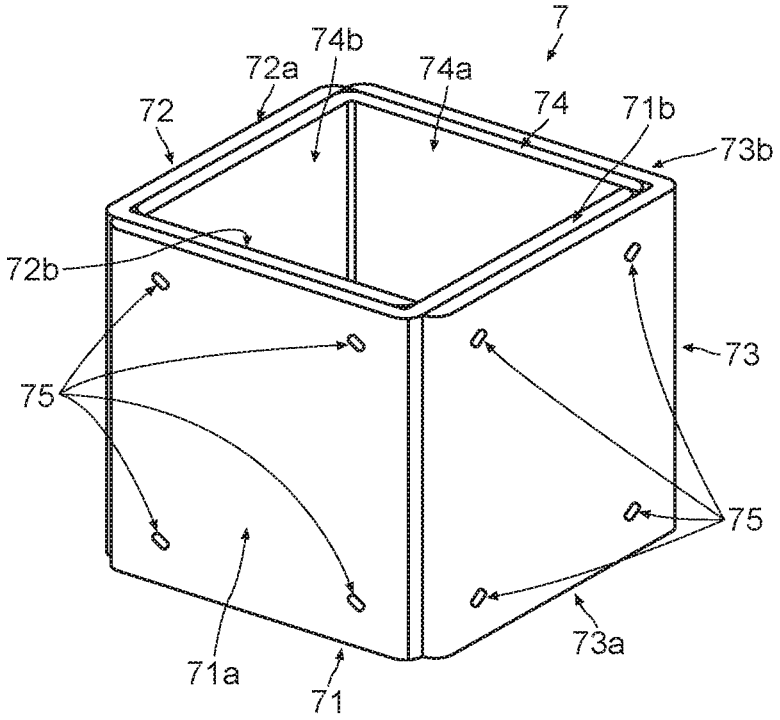
FIG. 7 illustrates a support member with a rectangular or square-shaped cross-section made by combining four L-section elements.

FIG. 7 illustrates how four sections of angle board 71, 72, 73, 74 are combined with one another to obtain a structural component with a square-shaped cross-section 7, which may be utilized as a vertical support member 32 or a support member 34.

To obtain a vertical support member or a support member with a square-shaped cross-section, two sections of angle board 71, 72 are first combined to form a structural component with a U-shaped or C-shaped cross-section. This is accomplished by mating the inner surface of the first leg 71*a* of the first angle board section 71 to the outer surface of the second leg 72*b* of the second angle board section 72, and attaching the two angle board sections to one another by stapling the outer surface of the mated legs 71*a*, 72*b* of the two angle board sections 71, 72. Staples 75 are embedded at each attachment point.

Another two sections of angle board 73, 74 are next combined to form another structural component with a U-shaped or C-shaped cross-section by mating the inner surface of the second leg 73*b* of the third angle board section 73 to the outer surface of the first leg 74*a* of the fourth angle board section 74, and then attaching the two angle board sections to one another by stapling the outer surface of the mated legs 73*b*, 74*a* of the two angle board sections 73, 74. Staples 75 are embedded at each attachment point.

The two U-shaped or C-shaped cross-sections assembled previously are then combined to form a structural component with a square-shaped cross-section 7, by mating and stapling the outer surface of the second leg 71*b* of the first angle board section 71 with the inner surface of the first leg 73*a* of the third angle board section 73, and by mating and stapling the inner surface of the first leg 72*a* of the second angle board section 72 to the outer surface of the second leg 74*b* of the fourth angle board section 74, and staples 75 are embedded at each attachment point.

The structural component with a square shaped cross-section 7 has a 'double-wall' construction which provides greater structural strength and load bearing capability. Other structural components with a rectangular shaped cross-section may also be obtained, simply by utilizing angle board sections with a first or second leg that has a greater length than the other leg.

Figure 8:
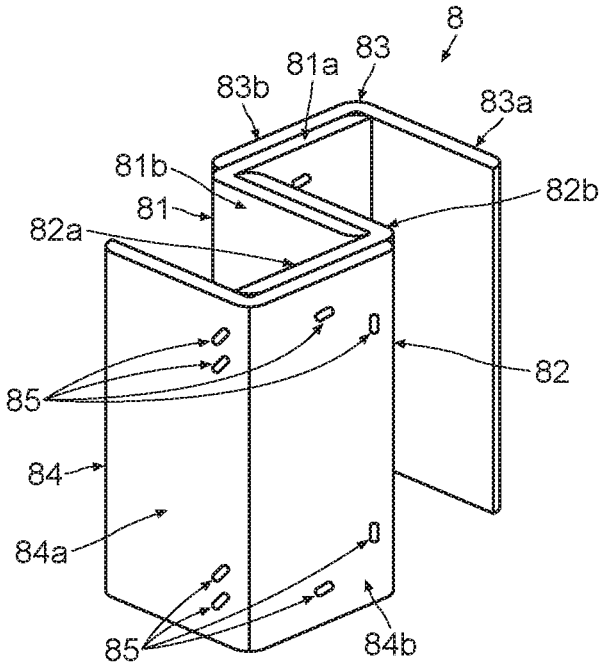
FIG. 8 illustrates a support member with a S-shaped cross-section made by combining four L-section elements.

FIG. 8 illustrates how four sections of angle board 81, 82, 83, 84 are combined with one another to obtain a structural component with a S-shaped cross-section 8, which may be utilized as a vertical support member or a support member.

To obtain a structural component with a S-shaped cross-section 8, a structural component with a Z-shaped cross-section is assembled beforehand by mating and attaching the inner surface of the second leg 81*b* of a first angle board section 81 to the inner surface of the second leg 82*b* of a second angle board section 82.

Subsequently, the inner surface of the second leg 83*b* of a third angle board section 83 is mated and attached to the outer surface of the first leg 81*a* of the first angle board section 81, and the inner surface of the second leg 84*b* of a fourth angle board section 84 is mated and attached to the outer surface of the first leg 82*a* of the second angle board section 82.

As with the structural members with the Z-shaped and square-shaped cross-sections, the angle board sections are attached to one another preferably by stapling, and staples 85 are embedded at each attachment point.

FIG. 9 illustrates in the perspective view, an individual top deck board 20 with a rectangular-shaped cross-section that has been obtained by combining four sections of angle board 21, 22, 23, 24 with one another.

To obtain a top deck board with a rectangular-shaped cross-section, it is necessary to utilize angle boards which have a first or second leg that has a greater length than the other leg.

Similar to the assembly of a structural component with a square shaped cross-section illustrated in FIG. 7, two sections of angle board 21, 22 are first combined to form a structural component with a U-shaped or C-shaped cross-section. This is accomplished by mating the inner surface of the longer leg of the first angle board section 21 to the outer surface of the longer leg of the second angle board section 22, and attaching the two angle board sections 21, 22 to one another by stapling the outer surface of the mated legs of the two angle board sections, and staples 25 are embedded at each attachment point.

Next, another two sections of angle board 23, 24 are next combined to form another structural component with a U-shaped or C-shaped cross-section. This is done by mating the outer surface of the longer leg of the third angle board section 23 to the inner surface of the longer leg of the fourth angle board section 24, and then attaching the two angle board sections 23, 24 to one another by stapling the outer surface of the mated legs of the two angle board sections, and staples 25 are embedded at each attachment point.

The two U-shaped or C-shaped cross-sections formed previously are then combined to form a structural component with a rectangular-shaped cross-section, by mating and stapling the outer surface of the shorter leg of the first angle board section 21 with the inner surface of the shorter of the third angle board section 23, and by mating and stapling the inner surface of the shorter leg of the second angle board section 22 to the outer surface of the shorter leg of the fourth angle board section 24. Staples 25 are embedded at each attachment point.

The top deck board 20 with a rectangular-shaped cross-section has a 'double-wall' construction which provides greater structural strength and load bearing capability.

Figure 10:
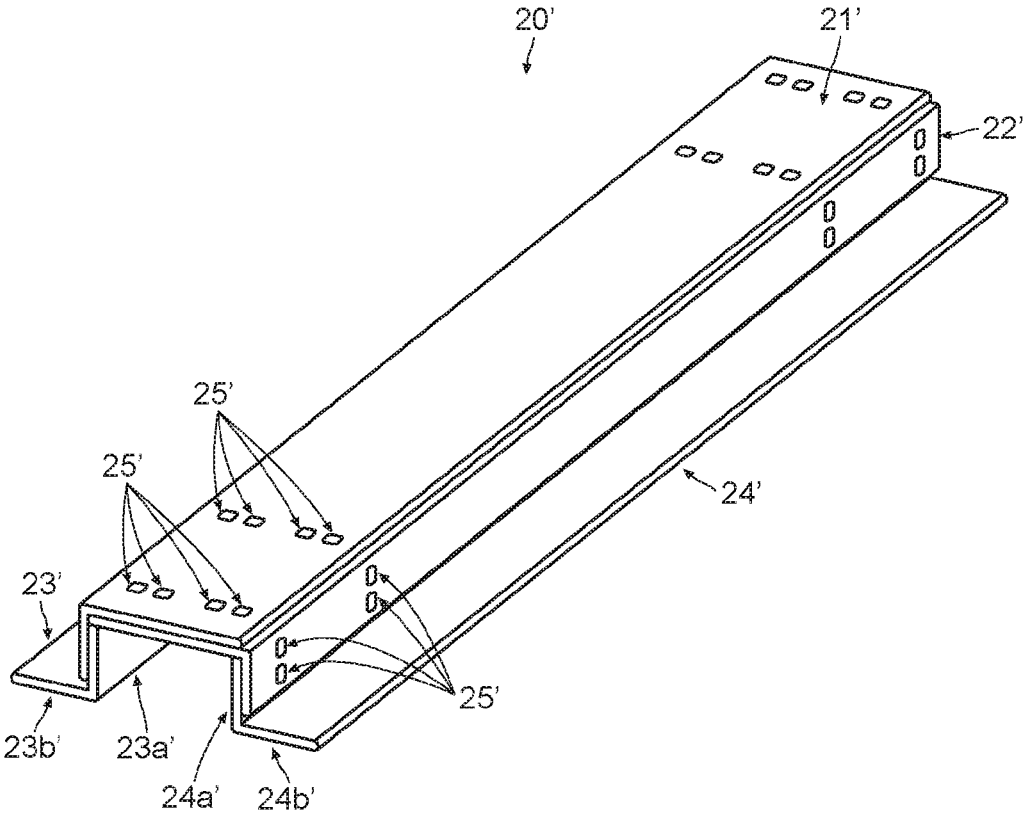
FIG. 10 illustrates a second configuration of a top deck board according to the invention.

FIG. 10 illustrates in the perspective view, an individual top deck board 20' with an inverted U-shaped cross-section with flanges 23*b*', 24*b*' on both sides of the open end, which has been formed by combining four sections of angle board 21', 22', 23', 24' with one another.

In the top deck board configuration illustrated in FIG. 10, two angle board sections with a first leg that have a length that is greater than the length of the second leg and two angle board sections with a first leg which has a length that is generally the same as the length of the second leg, are combined.

To obtain the top deck board configuration illustrated in FIG. 10, a first and a second section of angle board 21', 22' both having a first leg with a length that is greater than the length of the second leg are first combined to form a structural component with a U-shaped or C-shaped cross-section. This is accomplished by mating the inner surface of the longer leg of the first angle board section 21' to the outer surface of the longer leg of the second angle board section 22', and attaching the two angle board sections 21', 22' to one another by stapling the outer surface of the mated legs of the two angle board sections, and staples 25' are embedded at each attachment point.

Next, the inner surface of the first leg 23*a*' of a third angle board section 23' is mated and attached to the inner surface of the shorter leg of the first angle board section 21' preferably by stapling, and the inner surface of the first leg 24*a*' of a fourth angle board section 24' is mated and attached to the inner surface of the shorter leg of the second angle board section 22' also preferably by stapling. Staples 25' are embedded at each attachment point.

Figure 11:
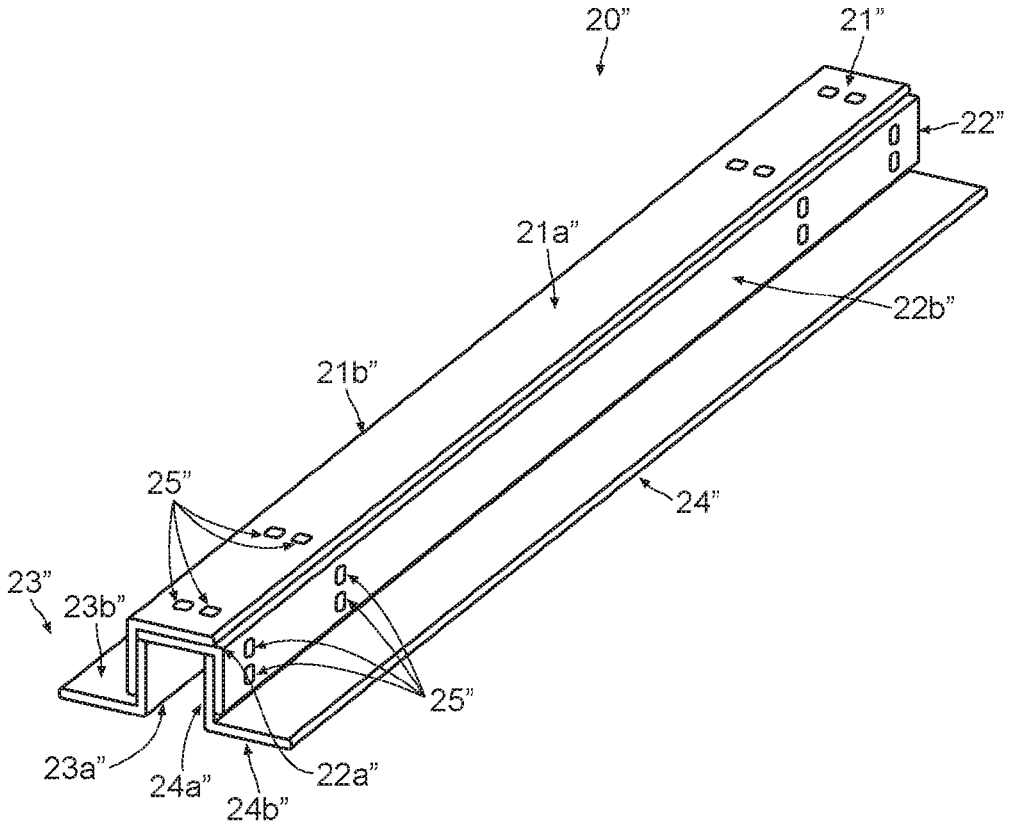
FIG. 11 illustrates a third configuration of a top deck board according to the invention.

FIG. 11 illustrates in the perspective view, another individual top deck board 20" with an inverted U-shaped cross-section with flanges 23*b*", 24*b*" on both sides of the open end, which has been formed by combining four sections of angle board with one another.

In the top deck board configuration illustrated in FIG. 11, four angle board sections 21", 22", 23", 24" with a first leg which has a length that is generally the same as the length of the second leg are combined.

To obtain the top deck board configuration illustrated in FIG. 11, a first and a second section of angle board 21", 22" are first combined to form a structural component with a U-shaped or C-shaped cross-section. This is accomplished by mating the inner surface of the first leg 21*a*" of the first angle board section 21" to the outer surface of the first leg 22*a*" of the second angle board section 22", and attaching the two angle board sections 21", 22" to one another by stapling the outer surface of the mated legs 21*a*", 22*a*" of the two angle board sections. Staples 25" are embedded at each attachment point.

Next, the inner surface of the first leg 23*a*" of a third angle board section 23" is mated and attached to the inner surface of the second leg 21*b*" of the first angle board section 21" preferably by stapling, and the inner surface of the first leg 24*a*" of a fourth angle board section 24" is mated and attached to the inner surface of the second leg 22*b*" of the second angle board section 22", also preferably by stapling. Staples 25" are embedded at each attachment point.

Figure 12:
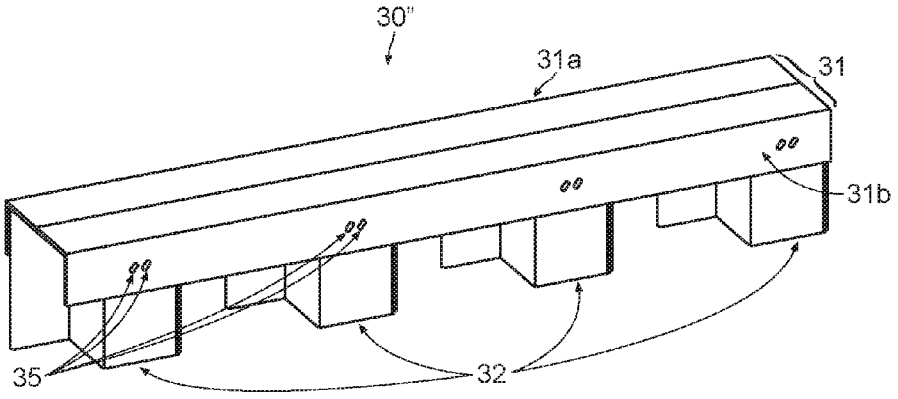
FIG. 12 illustrates a first configuration of a runner assembly according to the invention.

FIG. 12 illustrates in the perspective view, a first configuration of a support beam assembly 30" which is suitable for use as a runner for the skid 3 according to the first embodiment of the invention as illustrated in FIG. 3.

The support beam 30" illustrated in FIG. 12 comprises a top horizontal structural member 31, and a plurality of vertical support members 32. The plurality of vertical support members 32 are attached to the top horizontal support member 31 by stapling, and staples 35 are embedded at each attachment point. Although the vertical support members 32 are shown as a structural component with a Z-shaped cross-section such as the one illustrated in FIG. 6, this has been done solely as an example, and the support beam assembly is not limited solely to the use of a structural component with a Z-shaped cross-section. In fact, a vertical support member having a square-shaped cross-section or a S-shaped cross-section are equally applicable in the first configuration of the support beam assembly according to the invention.

Figure 13:
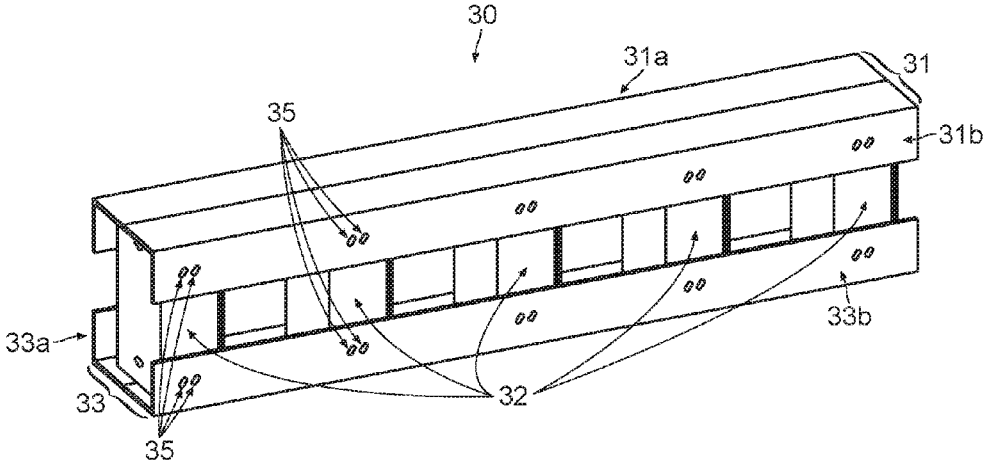
FIG. 13 illustrates a second configuration of a runner assembly according to the invention.

FIG. 13 illustrates in the perspective view, a second configuration of a support beam assembly 30 which is suitable for use as a runner for the skids 1, 2, 4 according to the first embodiment of the invention as illustrated in FIGS. 1, 2 and 4.

The second configuration of the support beam assembly 30 is also suited for use as a stringer for a pallet, as will be explained in the description.

The support beam assembly 30 illustrated in FIG. 13 comprises a top horizontal structural member 31, a base horizontal structural member 33 and a plurality of vertical support members 32. The plurality of vertical support members 32 are attached to the top horizontal support member 31 and base horizontal support member 33 by stapling, and staples 35 are embedded at each attachment point. Each of the vertical support members 32 has been shown as a structural component with a square-shaped cross-section such as the one illustrated in FIG. 7. However, this has been done solely by example, and the support beam assembly is not limited solely to the use of a structural component with a square-shaped cross-section. A vertical support member having a Z-shaped cross-section or a S-shaped cross-section such as that shown in FIG. 6 and FIG. 8 respectively, are equally applicable in the second configuration of the support beam assembly according to the invention.

Figure 14:
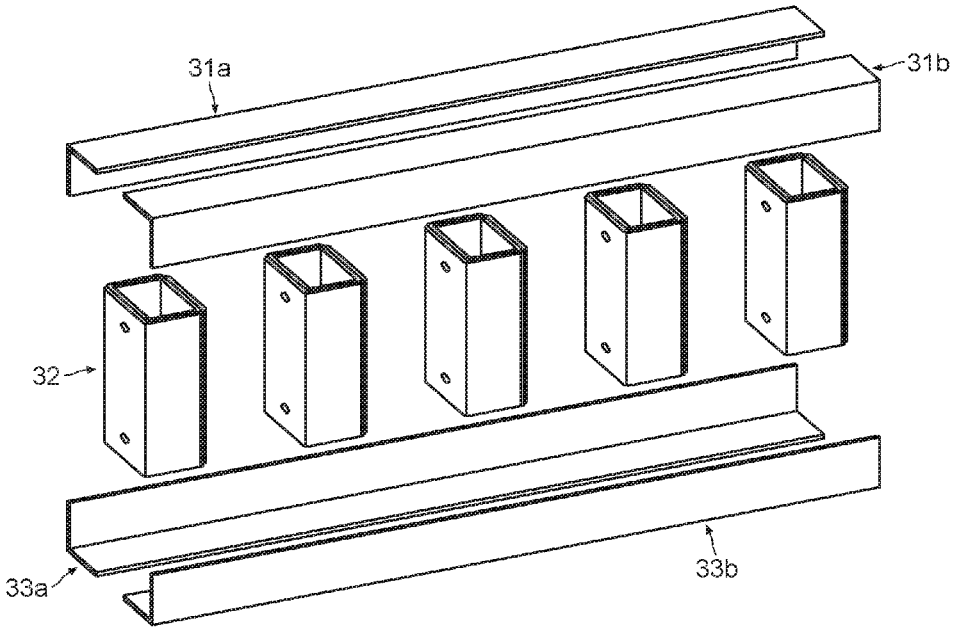
FIG. 14 illustrates the second configuration of a runner assembly according to the invention, in exploded form.

FIG. 14 illustrates an exploded perspective view of the second configuration of a support beam assembly 30 illustrated in FIG. 13, and explains how the support beam assembly is obtained by combining longitudinal sections of angle board material.

The top horizontal structural member 31 is a longitudinal structural member with an inverted U-shaped cross-section which is formed by arranging a pair of angle board sections 31*a*, 31*b* with a first leg and a second leg of the same length adjacent to one another.

The width of the opening of the inverted U-shaped cross-section of the top horizontal structural member 31 must correspond to the width of the upper end of the vertical support member 32, and it is possible to form the top horizontal structural member 31 by overlapping partially or completely, and then attaching the pair of angle board sections 31*a*, 31*b* to one another by stapling.

The plurality of the vertical support members 32 with a square-shaped cross-section are then mated and attached to the top horizontal structural members 31 at regular intervals, by stapling each vertical side of the top horizontal structural member (i.e., one leg of each angle board section) to a planar contact surface of each of the plurality of vertical support members.

When a vertical support member 32 with a Z-shaped cross-section or a S-shaped cross-section is utilized, the vertical support member must be orientated so that each vertical side of the top horizontal structural member 31 is mated to a planar contact surface of the vertical support member.

The base horizontal structural member 33 is a longitudinal structural member with a U-shaped cross-section which is formed by arranging a pair of angle board sections 33*a*, 33*b* with a first leg and a second leg of the same length adjacent to one another.

Similar to the top horizontal structural member 31, the width of the opening of the U-shaped cross-section of the base horizontal structural member 33 must correspond to the width of the lower end of the vertical support member 32, and it is also possible to form the base horizontal structural member by overlapping partially or completely, and then attaching the pair of angle board sections 33*a*, 33*b* to one another.

The plurality of the vertical support members 32 with a square-shaped cross-section are then mated and attached to the base horizontal structural members 33 at regular intervals, by stapling each vertical side of the base horizontal structural member (i.e., one leg of each angle board section) to a planar contact surface of each of the plurality of vertical support members.

The first and second configurations of the support beam assembly illustrated in FIGS. 12 and 13 share a high degree of commonality, in that both comprise a top horizontal structural member 31 and a plurality of vertical support members 32. In fact, the second configuration is essentially a derivative of the first configuration, which is made possible by the simple expedient of including a base horizontal structural member 33 as an additional component. As explained previously with regard to FIG. 3, the omission of the bottom horizontal structural member from the support beam assembly enables a skid to become an unrestricted four-way entry skid.

Bearing the similarities and differences between the first and second configurations in mind, the construction of the first configuration of the support beam can also be illustrated by FIG. 14, by simply omitting the step of including the base horizontal structural member 33.

It can be seen from FIGS. 12 to 14 that the number of vertical support members 32 used in a support beam assembly 30, and the spacing between each vertical support member may be varied depending on the type of skid required. As explained previously and will be understood from FIGS. 1 to 4, the number vertical support members 32 in the support beam assembly is dependent on whether a two-way entry or four-way entry skid is required.

However, as a general rule, the position of each vertical support member 32 should correspond to the position which a top deck board assembly 20*a*-20*e* is attached to the top and perpendicular to a beam support assembly 30, to provide a load bearing platform which ensures proper weight distribution. It is therefore preferred to include additional support members within a top horizontal structural member if the number of top deck boards does not correspond to the number of vertical support members.

FIG. 15 illustrates in the perspective view, a support beam assembly 30' with a top horizontal structural member 31 with three vertical support members 32 with a square-shaped cross-section that are equally spaced apart, and a support member 34 with a Z-shaped cross-section attached between each pair of vertical support members.

The support beam assembly 30' illustrated in FIG. 15 is similar to the ones shown in FIGS. 12 and 13, and is suitable for use as a runner for the skids according to the first embodiment of the invention as illustrated in FIGS. 2 and 3. Although a base horizontal structural member 33 is not shown, it will be obvious to a person skilled in the art that one may be readily incorporated.

The width of the support members 34 must correspond to the width of the opening the top horizontal structural member 31, and each support member 34 is orientated within the structural member so that each vertical side of the top horizontal structural member 31 is mated to a planar contact surface of each support member.

Each support member 34 is attached to the top horizontal structural members 31 by stapling each vertical side of the top horizontal structural member (i.e., one leg of each angle board section) to a planar contact surface of each support member, and staples 35 are embedded at each attachment point.

Although the support members 34 have been shown in FIG. 15 as a structural component with a Z-shaped cross-section such as the one illustrated in FIG. 6, this has been done solely by example. A support member 34 having a square-shaped cross-section or an S-shaped cross-section such as that shown in FIG. 7 and FIG. 8 respectively, or even a U-shaped cross-section may also be used without limitation or restriction.

The second embodiment of the invention relates to a pallet that is made from paper materials.

Figure 16:
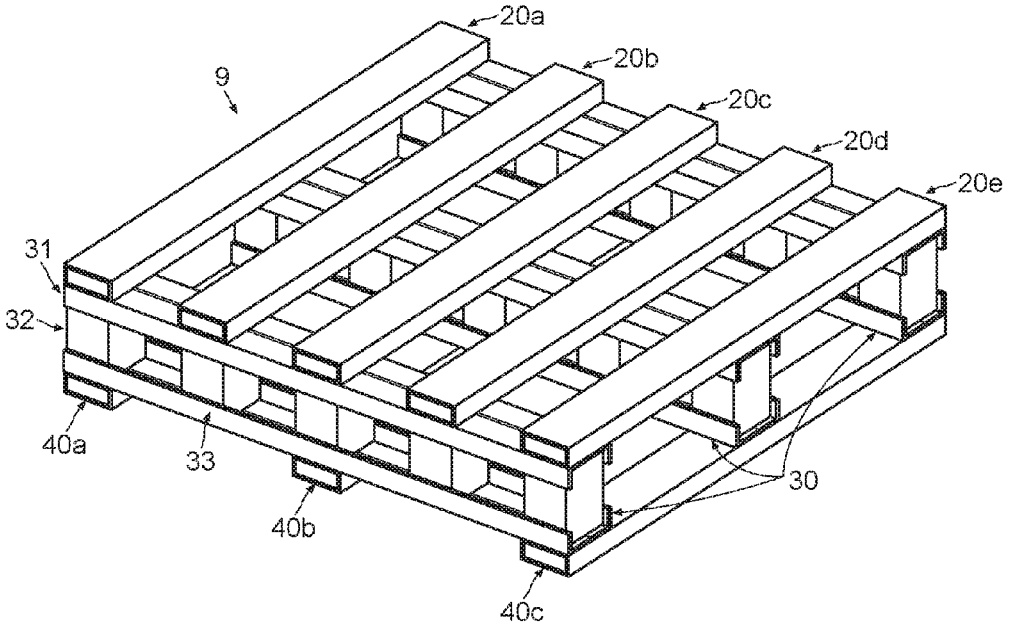
FIG. 16 illustrates a perspective view of a first variant of the second embodiment of the invention.

FIG. 16 illustrates a variant of the second embodiment of the invention in the perspective view.

The commonality of the components used in the first and second embodiments will be readily apparent to a person skilled in the art, since the difference between a pallet and a skid as explained previously, is the inclusion of a bottom deck in a pallet.

The previous description and explanation of the different configurations of the top deck boards 20*a*-20*e* and the support beam assemblies 30 and 30' are therefore equally applicable to the second embodiment of the invention, and the following explanation serves to describe the additional component of the bottom deck boards 40*a*-40*c*.

In FIG. 16, a first variant of a pallet 9 made of paper materials is illustrated comprises a plurality of top deck boards (five in this case) which are spaced apart equally, a plurality of bottom deck boards (three in this case) which are spaced apart equally, and a plurality of support beam assemblies (three in this case) which are attached between and perpendicular to the plurality of top deck boards and the plurality of bottom deck boards.

In the first variant of the pallet illustrated in FIG. 16, each of the top deck boards 20*a*-20*e* are depicted as having a rectangular-shaped cross-section which is same as that the one illustrated in FIG. 9. Further variants of the second embodiment may be envisioned incorporating top deck boards with either an inverted U-shaped cross-section with flanges on both sides of the open end such as that illustrated in FIGS. 10 and 11.

The bottom deck boards 40*a*-40*c* are illustrated in FIG. 16 as having a rectangular-shaped cross-section. A bottom deck board with a rectangular-shaped cross-section is deemed most optimal, as it provides a larger surface area that contacts the ground. This factor is critical for stability, and preventing a loaded pallet from tipping over inadvertently during handling.

The support beam assemblies 30 each include a top horizontal structural member 31, a plurality of vertical support members (five in this case) 32 whose positions correspond to the position of the top deck boards, and a base horizontal structural member 33.

The configuration of the first variant of the pallet 9 according to the invention is suitable for a two-way entry pallet for forklifts. A four-way entry pallet for forklifts may be obtained by incorporating fewer vertical support members in the support beam assemblies.

Figure 17:
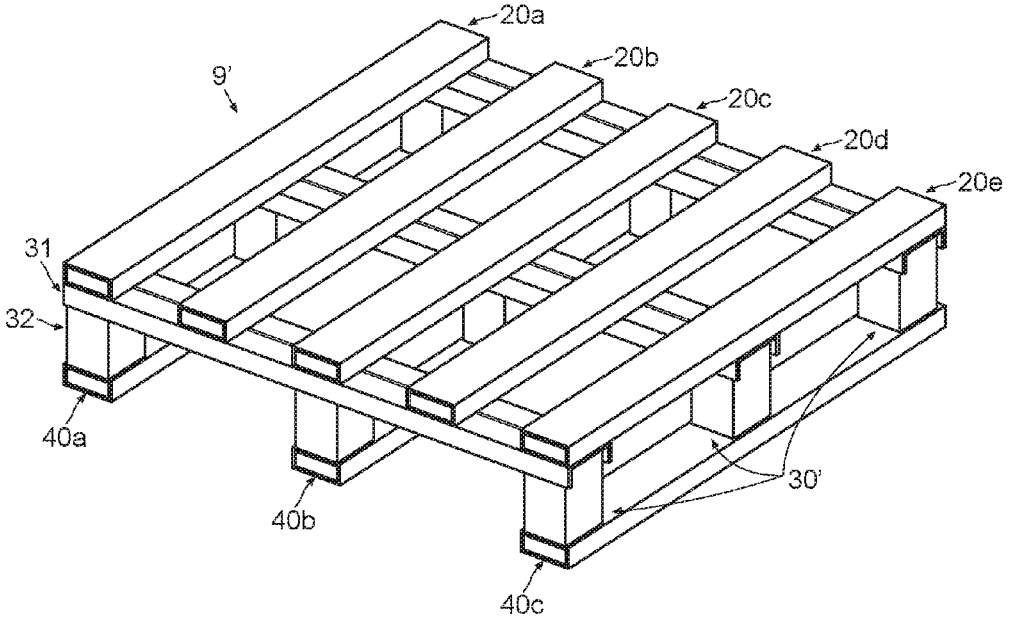
FIG. 17 illustrates a perspective view of a second variant of the second embodiment of the invention.

In FIG. 17, a second variant of a pallet 9' made of paper materials is illustrated that comprises a plurality of top deck boards (five in this case) which are spaced apart equally, a plurality of bottom deck boards (three in this case) which are spaced apart equally, and a plurality of support beam assemblies (three in this case) which are attached between and perpendicular to the plurality of top deck boards and the plurality of bottom deck boards.

In the second variant, the support beam assemblies 30' each include a top horizontal structural member 31, and a plurality of vertical support members (five in this case) 32 whose positions correspond to the position of the top deck boards.

As in FIG. 16, the bottom deck boards 40*a*-40*c* are illustrated in FIG. 16 as having a rectangular-shaped cross-section. However, the bottom deck boards 40*a*-40*c* are attached to the lower end of the vertical support members 32. In this variant, it is preferable for the vertical support members 32 to be made of thicker paper materials, or have a square-shaped cross-section such as the one illustrated in FIG. 7, to provide a larger surface area for attaching the bottom deck boards.

The configuration of the second variant of the pallet 9' according to the invention is suitable for a four-way entry pallet for forklifts, or a two-way entry pallet for pallet jacks.

The first variant of the pallet 9 is limited solely to the use of a forklift, and while the second variant of the pallet 9' may be used with both forklifts and pallet jacks, the use of a pallet jack is limited only to two-way entry. This is because a pallet jack requires an unobstructed path for the rollers within the end of the forks to pass under a pallet.

The presence of the base horizontal structural member 33 and the bottom deck boards 40*a*-40*c* on the first variant of the pallet 9 will therefore obstruct the entry of the forks of a pallet jack.

The absence of the base horizontal structural member 33, and the presence of the bottom deck boards 40*a*-40*c* on the second variant of the pallet 9' obstructs the entry of the forks of a pallet jack on two sides of the pallet, but still permits entry via the two remaining sides.

Figure 18:
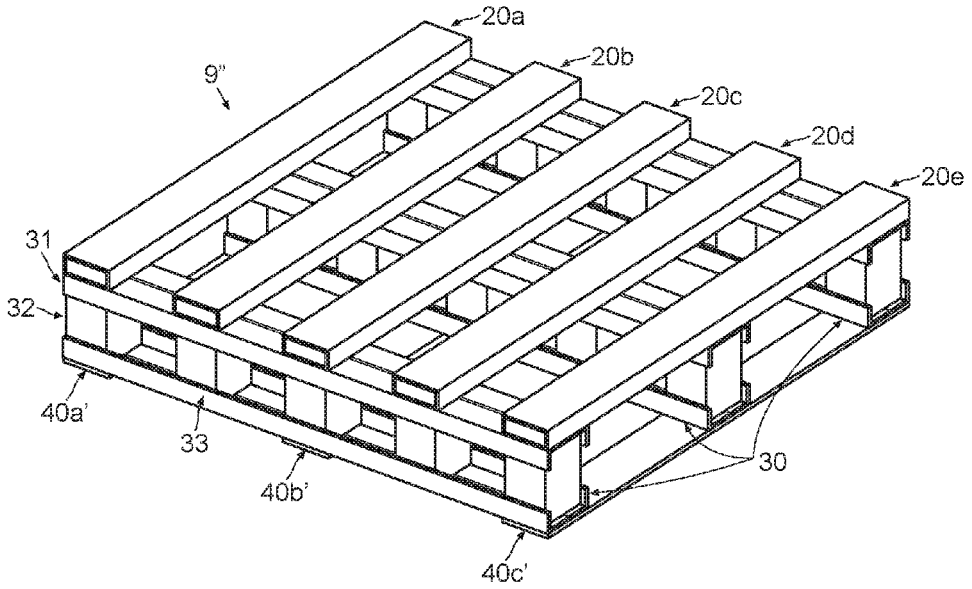
FIG. 18 illustrates a perspective view of a third variant of the second embodiment of the invention.

With the operating limitations of pallet jacks in mind, FIG. 18 illustrates a third embodiment of the pallet 9" made of paper materials which comprises a plurality of top deck boards (five in this case) which are spaced apart equally, a plurality of bottom deck boards (three in this case) which are spaced apart equally, and a plurality of support beam assemblies (three in this case) which are attached between and perpendicular to the plurality of top deck boards and the plurality of bottom deck boards.

The third embodiment of the pallet 9" is in fact a modification of the first variant of the second embodiment of the pallet 9, with the bottom deck boards 40*a*-40*c* replaced by planar longitudinal strips 40*a*', 40*b*', 40*c*' which are made of paper materials. Keeping in line with the theme of using angle board material, a length of angle board material may be divided longitudinally to separate the first leg from the second leg, and produce two planar longitudinal strips.

The planar longitudinal strips 40*a*', 40*b*', 40*c*' which now serve as the bottom deck boards are flat and of nominal thickness to allow the rollers within the forks of a pallet jack to pass over unobstructed. The third variant of the pallet 9" is suitable as a two-way entry pallet for both forklifts and pallet jacks.

Although not shown in the drawings, the second variant of the second embodiment of the pallet 9' may also form the basis of a further variant by replacing the bottom deck boards 40*a*-40*c* with planar longitudinal strips as described above in the third embodiment. Doing so produces another variant of a pallet which is suitable as a four-way entry pallet for both forklifts and pallet jacks.

The platform for the storage, stacking, handling and transportation of goods according to the invention is not limited to components which are made solely of paper materials as has been described thus far, and may in fact also be made by combining the components made of paper materials with components that are made of other suitable materials.

Since only raw wood is subject to the requirements of the ISPM-15 Standard, processed wood material which is exempted from the standard may be considered as a viable and cost-effective alternative that may be combined with other components which are made of paper materials to produce a paper-processed wood material composite skid or pallet. Examples of processed wood material include both particle board and medium-density fibre board (MDF board).

The fourth, fifth, sixth and seventh embodiments of the invention accordingly relate to platforms for the storage, stacking, handling and transportation of goods that comprises components made of paper materials, which have been combined with components made of processed wood.

Figure 19:
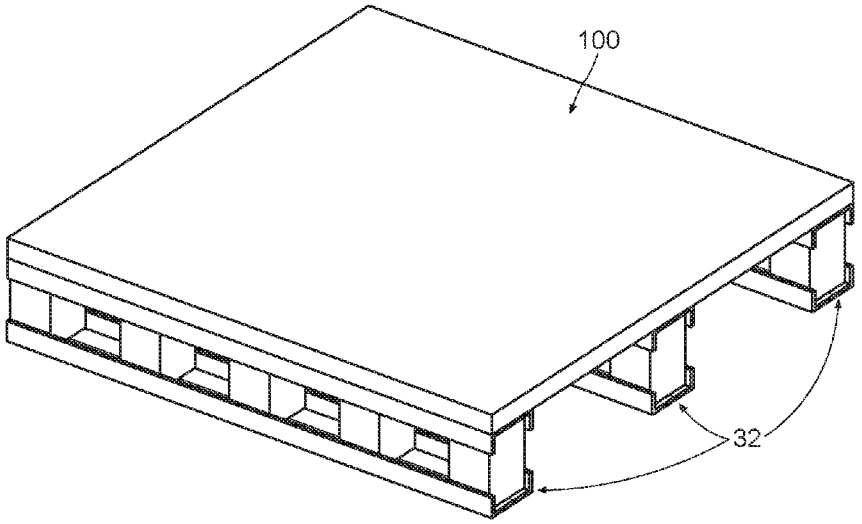
FIG. 19 illustrates a perspective view of a fourth embodiment of the invention.

FIG. 19 illustrates in the perspective view, the fourth embodiment of the invention which comprises a skid 10 which has a top deck comprising a processed wood-based panel or board 100 that is attached perpendicularly to the top of a plurality of support beam assemblies (three in this case) 30 which are made of paper materials.

In the fourth embodiment, the support beam assemblies 30 are constructed from a combination of a plurality of longitudinal elements having a L-section such as angle boards which are made of paper materials.

Although FIG. 19 illustrates the support beam assembly 30 of FIGS. 13 and 14 attached to the top deck, the configuration of the support beam assembly 30' illustrated in FIG. 12 may also be utilized without limitation or restriction.

The wood-based panel or board 100 used as the top deck is typically made from particle board or MDF board. Each support beam assembly 30 is attached to the processed wood-based panel or board by stapling or by gluing with a suitable adhesive, the top horizontal structural member to the base of the wood-based panel or board.

One benefit of the fourth embodiment of the invention is that all staples, nails or rivets used to attach the support beam assemblies are on the bottom surface of the processed wood-based panel or board. This is advantageous in preventing injuries while handling the platform, as the presence of splinters is greatly minimized by the absence of staples, nails or rivets on the top surface of the panel or board.

Figure 20:
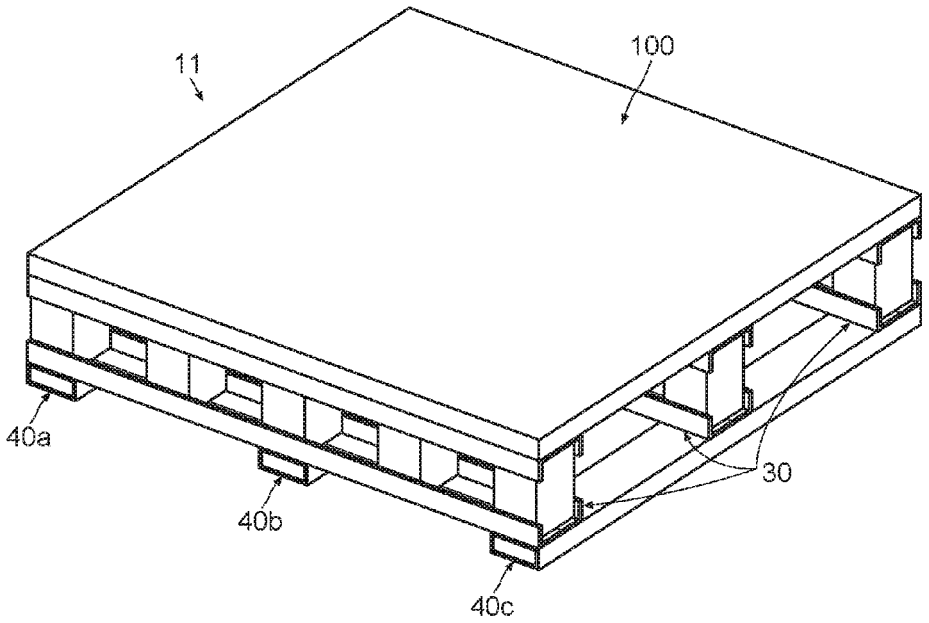
FIG. 20 illustrates a perspective view of a fifth embodiment of the invention.

FIG. 20 illustrates in the perspective view, a fifth embodiment of the present invention which comprises a pallet 11 which has a top deck comprising a processed wood-based panel or board 100, a plurality of bottom deck boards (three in this case) 40*a*-40*c* which are spaced apart equally, and a plurality of support beam assemblies (three in this case) 30 which are attached at regular intervals between and perpendicular to the top deck and the plurality of bottom deck boards.

The pallet 11 according to the fifth embodiment of the invention is in fact a modification based on the second embodiment of the invention, in that a singular wood-based panel or board 100 that is made from particle board or MDF board replaces the plurality of top deck boards used as the top deck of the pallet. Details of the support beam assembly and the bottom deck board may be respectively found in the descriptions of FIGS. 13 and 14, and FIG. 16. As in the fourth embodiment described previously, each support beam assembly 30 is attached to the processed wood-based panel or board 100 by stapling or by gluing with a suitable adhesive, the top horizontal structural member 31 to the base of the wood-based panel or board.

Although not shown in the drawings, the support beam assemblies 30' may also be used instead of support beam assemblies 30 in a variant of the fifth embodiment of the pallet, in a manner similar to that illustrated in FIG. 17.

Figure 21:
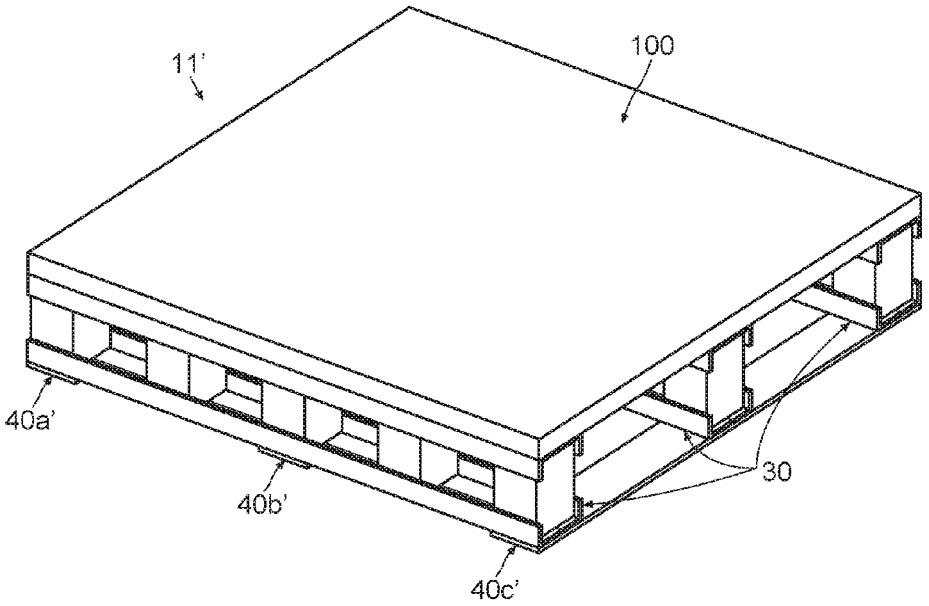
FIG. 21 illustrates a perspective view of a sixth embodiment of the invention.

FIG. 21 illustrates in the perspective view, a sixth embodiment of the present invention which comprises a pallet 11' which is a modification of the first variant with the bottom deck boards 40*a*-40*c* replaced by planar longitudinal strips 40*a*', 40*b*', 40*c*' which will serve as the bottom deck boards. As explained previously in the description of FIG. 18, doing so makes the pallet suitable for a two-way entry pallet for both forklifts and pallet jacks.

Figure 22:
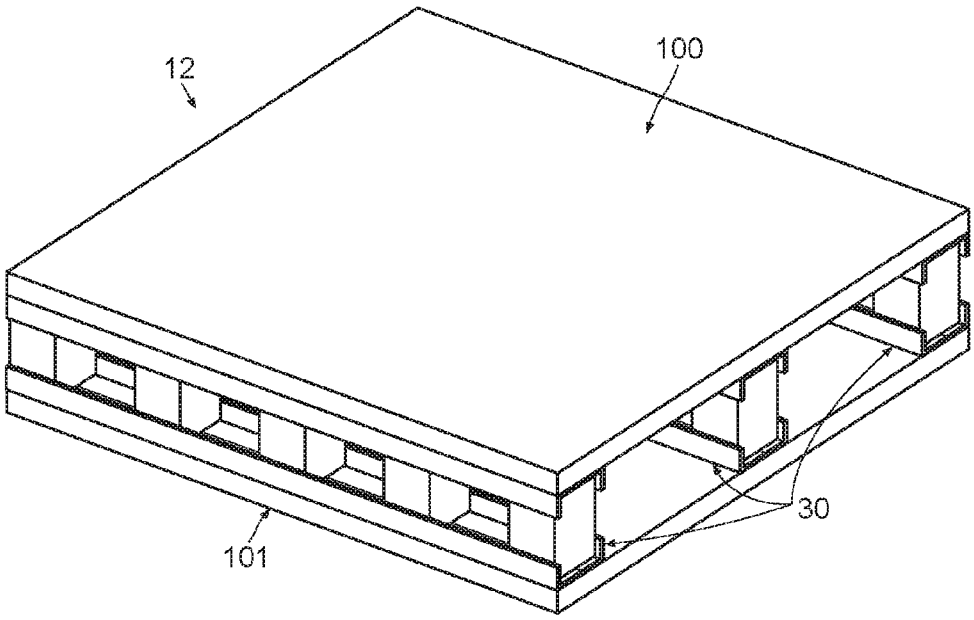
FIG. 22 illustrates a perspective view of a seventh embodiment of the invention.

FIG. 22 illustrates in the perspective view, the seventh embodiment of the present invention, a pallet 12 which has a top deck comprising a processed wood-based panel or board 100, a bottom deck comprising a processed wood-based panel or board 101, and a plurality of support beam assemblies (three in this case) 30 which are attached at regular intervals between and perpendicular to the top deck and the bottom deck of the pallet.

The pallet 12 according to the seventh embodiment of the invention is a modification of the fifth embodiment of the invention. In addition to the singular wood-based panel or board 100 that is made from particle board or MDF board replacing the plurality of top deck boards used as the top deck of the pallet, a singular wood-based panel or board 101 that is made from particle board or MDF board now replaces the plurality of bottom deck boards as well.

The support beam assembly 30 used in the seventh embodiment is of the same configuration as the one illustrated in FIGS. 13 and 14. Details of the support beam assembly may therefore be found in the description of the two figures. Each support beam assembly is attached to the processed wood-based panels or boards used as the top deck and bottom deck, by stapling or by gluing with a suitable adhesive. The top horizontal structural member 31 is attached to the base of the wood-based panel or board 100 used as the top deck, and the base horizontal structural member 33 is attached to the top of the wood-based panel or board 101 used as the bottom deck.

The use of processed wood-based materials is not limited to whole boards or panels such as has been illustrated in FIGS. 19-22. For example, individual planks made from processed wood-based materials may be also used as top deck boards or bottom deck boards, in place of the top deck boards and bottom deck boards made of L-shaped longitudinal elements used in the embodiments of the invention which have been illustrated in FIGS. 1-4 and FIGS. 16-18.

The inventiveness and the versatility of the present invention have both been demonstrated here. However, the present invention is not limited to the embodiments described here, as the description serves only to exemplify the invention and possible variations and further modifications are readily apparent without departing from the scope of the invention.

The invention claimed is:

1. A platform made of paper materials for the storage, stacking, handling and transportation of goods comprising:

a top deck comprising a plurality of top deck boards; and a plurality of support beam assemblies;

wherein the plurality of top deck boards are attached at regular intervals and perpendicular to the plurality of support beam assemblies;

wherein the top deck boards and the support beam assemblies are made solely from a combination of a plurality of longitudinal elements having a L-shaped cross-section, and wherein each of the plurality of top deck boards comprises four longitudinal elements having a L-shaped cross-section that have been combined to form a longitudinal structural element with an inverted U-shaped cross-section, which has a flange on both sides of the open end of the structural element.

2. A platform made of paper materials according to claim 1, wherein each of the plurality of support beam assemblies comprises a top horizontal structural member and a plurality of vertical support members, both of which are made solely by combining longitudinal elements having a L-shaped cross-section, wherein the top end of each vertical support member corresponds to and is received by the top horizontal support member.

3. The platform made of paper materials according to claim 2, wherein the top horizontal structural member comprises two longitudinal elements having a L-shaped cross-section which are arranged to form a longitudinal structural member with an inverted U-shaped cross-section, wherein the width of the opening of the longitudinal structural member corresponds to the width of the upper end of the vertical support member.

4. The platform made of paper materials according to claim 2, wherein the top horizontal structural member additionally comprises a plurality of support members which correspond to the width of the opening of the longitudinal structural member, and which are received by the opening of the top horizontal structural member, and wherein each support member is made solely by combining a plurality of truncated L-shaped cross-section elements.

5. The platform made of paper materials according to claim 4, wherein each of the support members are made by attaching a pair of truncated L-section elements together so as to create a support member with two planar contact surfaces.

6. The platform made of paper materials according to claim 5, wherein the support member with two planar contact surfaces has a Z-shaped cross-section.

7. The platform made of paper materials according to claim 5, wherein the support member with two planar contact surfaces has a U-shaped cross-section.

8. The platform made of paper materials according to claim 2, wherein the plurality of vertical support members are made by attaching a pair of L-shaped cross-section elements together so as to create a vertical support member with two planar contact surfaces.

9. The platform made of paper materials according to claim 8, wherein the vertical support member with two planar contact surfaces has a Z-shaped cross-section.

10. The platform made of paper materials according to claim 8, wherein the vertical support member with two planar contact surfaces has a U-shaped cross-section.

11. A platform made of paper materials according to claim 1, wherein each of the plurality of support beam assemblies comprises a top horizontal structural member, a plurality of vertical support members and a base horizontal structural member, all of which are made solely by combining longitudinal elements having a L-shaped cross-section, wherein the top end of each vertical support member corresponds to and is received by the top horizontal structural member, and the bottom end of each vertical support member corresponds to and is received by the base horizontal structural member.

12. The platform made of paper materials according to claim 11, wherein the plurality of vertical support members are made by attaching four L-shaped cross-section elements together so as create a vertical support member with four planar contact surfaces.

13. The platform made of paper materials according to claim 12, wherein the vertical support member with four planar contact surfaces has a square-shaped cross-section.

14. The platform made of paper materials according to claim 12, wherein the vertical support member with four planar contact surfaces has a S-shaped cross-section.

15. The platform made of paper materials according to claim 11, wherein the base horizontal structural member comprises two longitudinal elements having a L-shaped cross-section which are arranged to form a longitudinal structural member having a U-shaped cross-section, wherein the width of the opening of the longitudinal structural member corresponds to the width of the bottom end of the vertical support member.

16. A platform made of paper materials according to claim 1, wherein the platform further comprises a stiffening member attached perpendicularly to each end of the plurality of top deck boards, and wherein the stiffening member is a longitudinal element with a L-shaped cross-section.

17. A platform made of paper materials according to claim 1, wherein the L-shaped cross-section elements combined to form the individual components are attached to one another using metal staples, rivets or nails.

18. A platform made of paper materials according to claim 1, wherein the L-shaped cross-section elements combined to form the individual components are attached to one another using an adhesive.

19. A platform made of paper materials for the storage, stacking, handling and transportation of goods comprising:

a top deck comprising a plurality of top deck boards;

a bottom deck comprising a plurality of bottom deck boards; and a plurality of support beam assemblies;

wherein the plurality of support beam assemblies are attached at regular intervals between and perpendicular to the plurality of top deck boards and plurality of bottom deck boards;

wherein the top deck boards, the bottom deck boards and the support beam assemblies are made solely from a combination of a plurality of longitudinal elements having a L-shaped cross-section, and wherein each of the plurality of top deck boards comprises four longitudinal elements having a L-shaped cross-section that have been combined to form a longitudinal structural element with an inverted U-shaped cross-section, which has a flange on both sides of the open end of the structural element.

20. A platform made of paper materials for the storage, stacking, handling and transportation of goods comprising:

a top deck comprising a plurality of top deck boards which are made solely from a combination of a plurality of longitudinal elements having a L-shaped cross-section; a bottom deck comprising a plurality of planar longitudinal elements which are made from the legs of a longitudinal element having a L-section which has been divided longitudinally to separate the two adjoining legs; and a plurality of support beam assemblies which are made solely from a combination of a plurality of longitudinal elements having a L-shaped cross-section;

wherein each of the plurality of top deck boards comprises four longitudinal elements having a L-shaped cross-section that have been combined to form a longitudinal structural element with an inverted U-shaped cross-section, which has a flange on both sides of the open end of the structural element, and wherein the plurality of support beam assemblies are attached at regular intervals between and perpendicular to the plurality of top deck boards and plurality of planar longitudinal elements.

* * * * *